US008394255B2

(12) United States Patent
McCarthy et al.

(10) Patent No.: US 8,394,255 B2
(45) Date of Patent: Mar. 12, 2013

(54) INTEGRATED HYDROCRACKING AND DEWAXING OF HYDROCARBONS

(75) Inventors: Stephen J. McCarthy, Center Valley, PA (US); Gary Paul Schleicher, Milford, NJ (US); Krista Marie Prentice, Bethlehem, PA (US); Michel Daage, Hellertown, PA (US); Christopher Gordon Oliveri, Annandale, NJ (US); Thomas Francis Degnan, Moorestown, NJ (US); José Guadalupe Santiesteban, Hellertown, PA (US); Ajit Bhaskar Dandekar, Bridgewater, NJ (US); William Joseph Novak, Bedminster, NJ (US); Wenyih F. Lai, Bridgewater, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 604 days.

(21) Appl. No.: 12/655,128

(22) Filed: Dec. 23, 2009

(65) Prior Publication Data

US 2010/0187155 A1 Jul. 29, 2010

Related U.S. Application Data

(60) Provisional application No. 61/204,057, filed on Dec. 31, 2008.

(51) Int. Cl.

| | |
|---|---|
| ***C10G 73/02*** | (2006.01) |
| ***C10G 47/02*** | (2006.01) |
| ***C10G 47/16*** | (2006.01) |
| ***B01J 29/70*** | (2006.01) |

(52) U.S. Cl. ..... 208/28; 208/58; 208/46; 208/109; 208/134

(58) Field of Classification Search ..... 208/27; 502/60

See application file for complete search history.

(56) References Cited

U.S. PATENT DOCUMENTS

| | | | | |
|---|---|---|---|---|
| 3,900,427 | A * | 8/1975 | Riley et al. | 502/255 |
| 4,397,827 | A * | 8/1983 | Chu | 423/705 |
| 5,603,824 | A * | 2/1997 | Kyan et al. | 208/208 R |
| 6,569,313 | B1 * | 5/2003 | Carroll et al. | 208/49 |
| 7,179,365 | B2 * | 2/2007 | Aldous et al. | 208/49 |
| 2003/0102254 | A1 * | 6/2003 | Eijsbouts et al. | 208/216 R |
| 2003/0168379 | A1 | 9/2003 | Degnan et al. | |
| 2004/0079677 | A1 * | 4/2004 | Farshid | 208/89 |
| 2006/0247480 | A1 | 11/2006 | Jan et al. | |
| 2007/0131582 | A1 | 6/2007 | Lai et al. | |

OTHER PUBLICATIONS

Johnson, M.F.L., "Estimation of the Zeolite Content of a Catalyst from Nitrogen Adsorption Isotherms", J. Catalysis, 425 (1978).

* cited by examiner

*Primary Examiner* — Walter D Griffin
*Assistant Examiner* — Derek Mueller
(74) *Attorney, Agent, or Firm* — Robert A. Migliorini

(57) ABSTRACT

An integrated process for producing naphtha fuel, diesel fuel and/or lubricant base oils from feedstocks under sour conditions is provided. The ability to process feedstocks under higher sulfur and/or nitrogen conditions allows for reduced cost processing and increases the flexibility in selecting a suitable feedstock. The sour feed can be delivered to a catalytic dewaxing step without any separation of sulfur and nitrogen contaminants, or a high pressure separation can be used to partially eliminate contaminants. The integrated process includes an initial hydrotreatment, hydrocracking, catalytic dewaxing of the hydrocracking effluent, and an option final hydrotreatment.

51 Claims, 6 Drawing Sheets

INTEGRATED HYDROCRACKING AND DEWAXING OF HYDROCARBONS

CROSS-REFERENCE TO RELATED APPLICATIONS

This is a Non-Provisional Application that claims priority to U.S. Provisional Application No. 61/204,057 filed Dec. 31, 2008, which is herein incorporated by reference in its entirety.

FIELD

This disclosure provides a catalyst and a method of using such a catalyst for processing of sulfur and/or nitrogen content feedstocks to produce naphtha fuels, diesel fuels and lubricating oil basestocks.

BACKGROUND

Hydrocracking of hydrocarbon feedstocks is often used to convert lower value hydrocarbon fractions into higher value products, such as conversion of vacuum gas oil (VGO) feedstocks to diesel fuel and lubricants. Typical hydrocracking reaction schemes can include an initial hydrotreatment step, a hydrocracking step, and a post hydrotreatment step. After these steps, the effluent can be fractionated to separate out a desired diesel fuel and/or lubricant oil basestock.

One method of classifying lubricating oil basestocks is that used by the American Petroleum Institute (API). API Group II basestocks have a saturates content of 90 wt % or greater, a sulfur content of not more than 0.03 wt % and a VI greater than 80 but less than 120. API Group III basestocks are the same as Group II basestocks except that the VI is at least 120. A process scheme such as the one detailed above is typically suitable for production of Group II and Group III basestocks from an appropriate feed.

One way to improve the yield of a desired product is to use catalytic dewaxing to modify heavier molecules. Unfortunately, conventional methods for producing low pour point or low cloud point diesel fuel and/or lubricant oil basestock are hindered due to differing sensitivities for the catalysts involved in the various stages. This limits the selection of feeds which are potentially suitable for use in forming dewaxed diesel and/or Group II or higher basestocks. In conventional processing, the catalysts used for the hydroprocessing and hydrocracking of the oil fraction often have a relatively high tolerance for contaminants such as sulfur or nitrogen. By contrast, catalysts for catalytic dewaxing usually suffer from a low tolerance for contaminants. In particular, dewaxing catalysts that are selective for producing high yields of diesel and high yields and high VI lube oil and are intended to operate primarily by isomerization are typically quite sensitive to the amount of sulfur and/or nitrogen present in a feed. If contaminants are present, the activity, distillate selectivity and lubricating oil yield of the dewaxing catalyst will be reduced.

To accommodate the differing tolerances of the catalysts, a catalytic dewaxing step is often segregated from other hydroprocessing steps. In addition to requiring a separate reactor for the catalytic dewaxing, this segregation requires costly facilities and is inconvenient as it dictates the order of steps in the hydroprocessing sequence.

SUMMARY

In an embodiment, a method is provided for producing a naphtha fuel, a diesel fuel, and a lubricant basestock, including: contacting a hydrotreated feedstock and a hydrogen containing gas with a hydrocracking catalyst under effective hydrocracking conditions to produce a hydrocracked effluent, cascading the entire hydrocracked effluent, without separation, to a catalytic dewaxing stage, and dewaxing the entire hydrocracked effluent under effective catalytic dewaxing conditions, wherein the combined total sulfur in liquid and gaseous forms fed to the dewaxing stage is greater than 1000 ppm by weight of sulfur on the hydrotreated feedstock basis, wherein the hydrocracking catalyst includes a zeolite Y based catalyst, and wherein the dewaxing catalyst includes at least one non-dealuminated, unidimensional, 10-member ring pore zeolite, at least one Group VIII metal, and at least one low surface area, metal oxide, refractory binder.

In an another embodiment, a method is provided for producing a naphtha fuel, a diesel fuel, and a lubricant basestock, including: contacting a hydrotreated feedstock and a hydrogen containing gas with a hydrocracking catalyst under effective hydrocracking conditions to produce a hydrocracked effluent, wherein prior to the contacting step, the effluent from the hydrotreating step is fed to at least one high pressure separator to separate the gaseous portion of the hydrotreated effluent from the liquid portion of the hydrotreated effluent, wherein the entire hydrocracked effluent is cascaded, without separation, to a catalytic dewaxing stage, and dewaxing the entire hydrocracked effluent under effective catalytic dewaxing conditions, wherein the combined total sulfur in liquid and gaseous forms fed to the dewaxing stage is greater than 1000 ppm by weight of sulfur on the hydrotreated feedstock basis, wherein the hydrocracking catalyst includes a zeolite Y based catalyst, and wherein the dewaxing catalyst includes at least one non-dealuminated, unidimensional, 10-member ring pore zeolite, at least one Group VIII metal, and at least one low surface area, metal oxide, refractory binder.

In yet another embodiment, a method is provided for producing a naphtha fuel, a diesel fuel, and a lubricant basestock, including: contacting a hydrotreated feedstock and a hydrogen containing gas with a hydrocracking catalyst under effective hydrocracking conditions to produce a hydrocracked effluent, cascading the entire hydrocracked effluent, without separation, to a catalytic dewaxing stage, and dewaxing the entire hydrocracked effluent under effective catalytic dewaxing conditions, wherein the combined total sulfur in liquid and gaseous forms fed to the dewaxing stage is greater than 1000 ppm by weight of sulfur on the hydrotreated feedstock basis, wherein the hydrocracking catalyst includes a zeolite Y based catalyst, and wherein the dewaxing catalyst includes at least one non-dealuminated, unidimensional, 10-member ring pore zeolite and at least one Group VIII metal.

In still yet another embodiment, a method is provided for producing a naphtha fuel, a diesel fuel, and a lubricant basestock, including: contacting a hydrotreated feedstock and a hydrogen containing gas with a hydrocracking catalyst under effective hydrocracking conditions to produce a hydrocracked effluent, wherein prior to the contacting step, the effluent from the hydrotreating step is fed to at least one high pressure separator to separate the gaseous portion of the hydrotreated effluent from the liquid portion of the hydrotreated effluent, wherein the entire hydrocracked effluent is cascaded, without separation, to a catalytic dewaxing stage, and dewaxing the entire hydrocracked effluent under effective catalytic dewaxing conditions, wherein the combined total sulfur in liquid and gaseous forms fed to the dewaxing stage is greater than 1000 ppm by weight of sulfur on the hydrotreated feedstock basis, wherein the hydrocracking catalyst includes a zeolite Y based catalyst, and wherein the dewaxing catalyst includes at least one non-dealuminated, unidimensional, 10-member ring pore zeolite, and at least one Group VIII metal.

DETAILED DESCRIPTION

Figure 1:
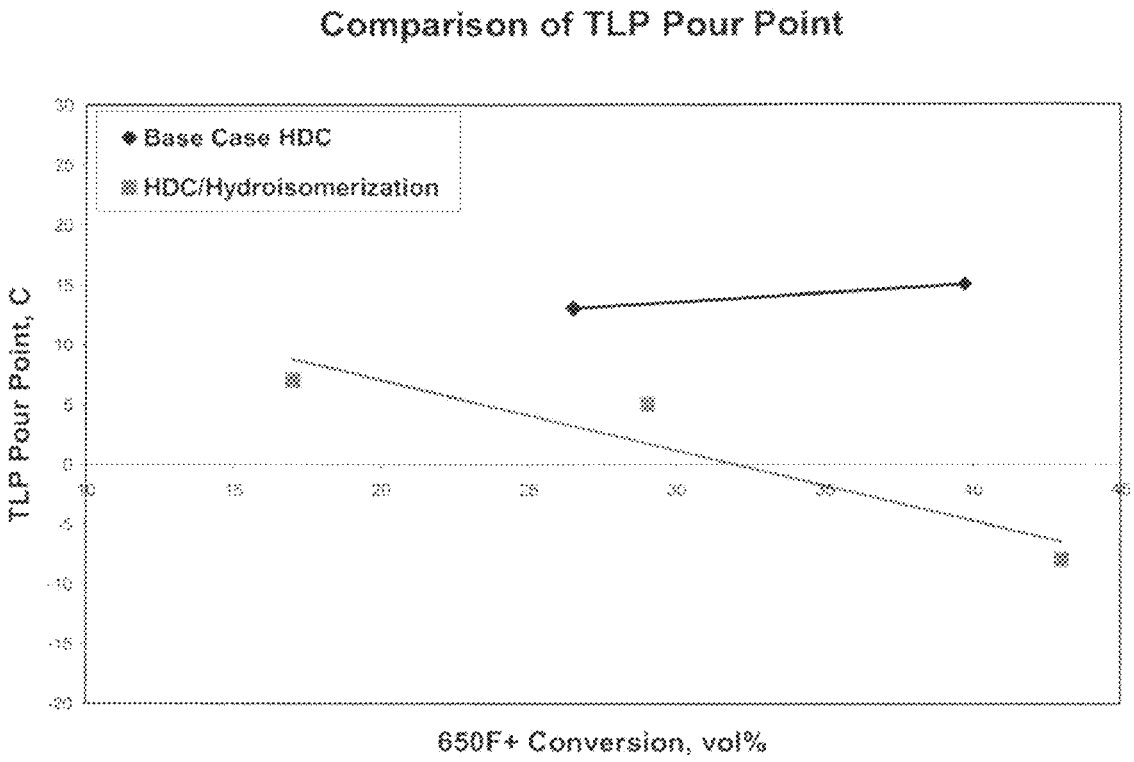
FIG. 1 is a plot of total liquid product (TLP) pour point versus 650° F.+ conversion.

All numerical values within the detailed description and the claims herein are modified by "about" or "approximately" the indicated value, and take into account experimental error and variations that would be expected by a person having ordinary skill in the art.

Overview

In various embodiments, a process is provided for the production of lubricant basestocks and/or low cloud and low pour distillate fuels that includes catalytic dewaxing of the feed in a sour environment. A sour environment is one in which the total combined sulfur levels in liquid and gaseous forms is greater than 1000 ppm by weight on the hydrotreated feedstock basis. Catalytic dewaxing in the present disclosure is also referred to as hydroisomerization. The ability to perform the catalytic dewaxing/hydroisomerization in a sour environment offers several advantages. The number and types of initial oil fractions available for processing can be expanded due to the tolerance for contaminants in the dewaxing step. The overall cost of the process should be lower, as the ability to perform dewaxing in a sour environment will reduce the equipment needed for processing. The yield for lube and/or distillate fuel production may be improved, as the processing conditions will be selected to meet desired specifications, as opposed to selecting conditions to avoid the exposure of the dewaxing catalyst to contaminants. The VI of the lube fraction may also be increased. Finally, the diesel yield may further be increased by increasing the diesel endpoint because the pour and/or cloud constraint on the diesel product has been removed.

The inventive process involves the use of a dewaxing catalyst suitable for use in a sour environment while minimizing conversion of higher boiling molecules to naphtha and other less valuable species. The dewaxing catalyst is used as part of an integrated process including an initial hydrotreatment of the feed, hydrocracking of the hydrotreated feed, dewaxing of the effluent from the hydrocracking, and an optional final hydrotreatment. Because the dewaxing catalyst is capable of tolerating a sour environment, all of the above steps can be included in a single reactor, thus avoiding the need for costly additional reactors and other equipment for performing this integrated process.

The dewaxing catalysts used according to the invention provide an activity advantage relative to conventional dewaxing catalysts in the presence of sulfur feeds. In the context of dewaxing, a sulfur feed can represent a feed containing at least 100 ppm by weight of sulfur, or at least 1000 ppm by weight of sulfur, or at least 2000 ppm by weight of sulfur, or at least 4000 ppm by weight of sulfur, or at least 40,000 ppm by weight of sulfur. The feed and hydrogen gas mixture can include greater than 1,000 ppm by weight of sulfur or more, or 5,000 ppm by weight of sulfur or more, or 15,000 ppm by weight of sulfur or more. In yet another embodiment, the sulfur may be present in the gas only, the liquid only or both. For the present disclosure, these sulfur levels are defined as the total combined sulfur in liquid and gas forms fed to the dewaxing stage in parts per million (ppm) by weight on the hydrotreated feedstock basis.

This advantage is achieved by the use of a catalyst comprising a 10-member ring pore, one-dimensional zeolite in combination with a low surface area metal oxide refractory binder, both of which are selected to obtain a high ratio of micropore surface area to total surface area. Alternatively, the zeolite has a low silica to alumina ratio. The dewaxing catalyst further includes a metal hydrogenation function, such as a Group VIII metal, preferably a Group VIII noble metal. Preferably, the dewaxing catalyst is a one-dimensional 10-member ring pore catalyst, such as ZSM-48 or ZSM-23.

The external surface area and the micropore surface area refer to one way of characterizing the total surface area of a catalyst. These surface areas are calculated based on analysis of nitrogen porosimetry data using the BET method for surface area measurement. (See, for example, Johnson, M. F. L., Jour. Catal., 52, 425 (1978).) The micropore surface area refers to surface area due to the unidimensional pores of the zeolite in the dewaxing catalyst. Only the zeolite in a catalyst will contribute to this portion of the surface area. The external surface area can be due to either zeolite or binder within a catalyst.

Feedstocks

A wide range of petroleum and chemical feedstocks can be hydroprocessed in accordance with the present invention. Suitable feedstocks include whole and reduced petroleum crudes, atmospheric and vacuum residua, propane deasphalted residua, e.g., brightstock, cycle oils, FCC tower bottoms, gas oils, including atmospheric and vacuum gas oils and coker gas oils, light to heavy distillates including raw virgin distillates, hydrocrackates, hydrotreated oils, dewaxed oils, slack waxes, Fischer-Tropsch waxes, raffinates, and mixtures of these materials. Typical feeds would include, for example, vacuum gas oils boiling up to about 593° C. (about 1100° F.) and usually in the range of about 350° C. to about 500° C. (about 660° F. to about 935° F.) and, in this case, the proportion of diesel fuel produced is correspondingly greater.

Initial Hydrotreatment of Feed

The primary purpose of hydrotreating is typically to reduce the sulfur, nitrogen, and aromatic content of a feed, and is not primarily concerned with boiling point conversion of the feed. Hydrotreating conditions include temperatures of 200° C.-450° C. or more preferably 315-425° C., pressures of 250-5000 psig (1.8 MPa-34.6 MPa) or more preferably 300-3000 psig (2.1 MPa-20.8 MPa), Liquid Hourly Space Velocities (LHSV) of 0.2-10 $h^{-1}$ and hydrogen treat rates of 200-10,000 scf/B (35.6 $m^3/m^3$-1781 $m^3/m^3$) or more preferably 500-10,000 scf/B (89 $m^3/m^3$-1781 $m^3/m^3$). Hydrotreating catalysts are typically those containing Group VIB metals (based on the Periodic Table published by Fisher Scientific), and non-noble Group VIII metals, i.e., iron, cobalt and nickel and mixtures thereof. These metals or mixtures of metals are typically present as oxides or sulfides on refractory metal oxide supports. Suitable metal oxide supports include low acidic oxides such as silica, alumina or titania, preferably alumina. Preferred aluminas are porous aluminas such as gamma or eta having average pore sizes from 50 to 200 Å, preferably 75 to 150 Å, a surface area from 100 to 300 $m^2/g$, preferably 150 to 250 $m^2/g$ and a pore volume of from 0.25 to 1.0 $cm^3/g$, preferably 0.35 to 0.8 $cm^3/g$. The supports are preferably not promoted with a halogen such as fluorine as this generally increases the acidity of the support.

Preferred metal catalysts include cobalt/molybdenum (1-10% Co as oxide, 10-40% Mo as oxide) nickel/molybdenum (1-10% Ni as oxide, 10-40% Co as oxide) or nickel/tungsten (1-10% Ni as oxide, 10-40% W as oxide) on alumina. Especially preferred are nickel/molybdenum catalysts such as KF-840, KF-848 or a stacked bed of KF-848 or KF-840 and Nebula-20.

Alternatively, the hydrotreating catalyst can be a bulk metal catalyst, or a combination of stacked beds of supported and bulk metal catalyst. By bulk metal, it is meant that the catalysts are unsupported wherein the bulk catalyst particles comprise 30-100 wt. % of at least one Group VIII non-noble metal and at least one Group VIB metal, based on the total weight of the bulk catalyst particles, calculated as metal oxides and wherein the bulk catalyst particles have a surface area of at least 10 $m^2/g$. It is furthermore preferred that the bulk metal hydrotreating catalysts used herein comprise about 50 to about 100 wt %, and even more preferably about 70 to about 100 wt %, of at least one Group VIII non-noble metal and at least one Group VIB metal, based on the total weight of the particles, calculated as metal oxides. The amount of Group VIB and Group VIII non-noble metals can easily be determined VIB TEM-EDX.

Bulk catalyst compositions comprising one Group VIII non-noble metal and two Group VIB metals are preferred. It has been found that in this case, the bulk catalyst particles are sintering-resistant. Thus the active surface area of the bulk catalyst particles is maintained during use. The molar ratio of Group VIB to Group VIII non-noble metals ranges generally from 10:1-1:10 and preferably from 3:1-1:3. In the case of a core-shell structured particle, these ratios of course apply to the metals contained in the shell. If more than one Group VIB metal is contained in the bulk catalyst particles, the ratio of the different Group VIB metals is generally not critical. The same holds when more than one Group VIII non-noble metal is applied. In the case where molybdenum and tungsten are present as Group VIB metals, the molybenum:tungsten ratio preferably lies in the range of 9:1-1:9. Preferably the Group VIII non-noble metal comprises nickel and/or cobalt. It is further preferred that the Group VIB metal comprises a combination of molybdenum and tungsten. Preferably, combinations of nickel/molybdenum/tungsten and cobalt/molybdenum/tungsten and nickel/cobalt/molybdenum/tungsten are used. These types of precipitates appear to be sinter-resistant. Thus, the active surface area of the precipitate is maintained during use. The metals are preferably present as oxidic compounds of the corresponding metals, or if the catalyst composition has been sulfided, sulfidic compounds of the corresponding metals.

It is also preferred that the bulk metal hydrotreating catalysts used herein have a surface area of at least 50 $m^2/g$ and more preferably of at least 100 $m^2/g$. It is also desired that the pore size distribution of the bulk metal hydrotreating catalysts be approximately the same as the one of conventional hydrotreating catalysts. More in particular, these bulk metal hydrotreating catalysts have preferably a pore volume of 0.05-5 ml/g, more preferably of 0.1-4 ml/g, still more preferably of 0.1-3 ml/g and most preferably 0.1-2 ml/g determined by nitrogen adsorption. Preferably, pores smaller than 1 nm are not present. Furthermore these bulk metal hydrotreating catalysts preferably have a median diameter of at least 50 nm, more preferably at least 100 nm, and preferably not more than 5000 μm and more preferably not more than 3000 μm. Even more preferably, the median particle diameter lies in the range of 0.1-50 μm and most preferably in the range of 0.5-50 μm.

Hydrocracking Process

Hydrocracking catalysts typically contain sulfided base metals on acidic supports, such as amorphous silica alumina, cracking zeolites such as USY, acidified alumina. Often these acidic supports are mixed or bound with other metal oxides such as alumina, titania or silica.

The hydrocracking process can be carried out at temperatures of from about 200° C. to about 450° C., hydrogen pressures of from about 250 psig to about 5000 psig (1.8 MPa to 34.6 MPa), liquid hourly space velocities of from about 0.2 $h^{-1}$ to about 10 $h^{-1}$ and hydrogen treat gas rates of from about 35.6 $m^3/m^3$ to about 1781 $m^3/m^3$ (about 200 SCF/B to about 10,000 SCF/B). Typically, in most cases, the conditions will have temperatures in the range of about 300° C. to about 450° C., hydrogen pressures of from about 500 psig to about 2000 psig (3.5 MPa-13.9 MPa), liquid hourly space velocities of from about 0.5 $h^{-1}$ to about 2 $h^{-1}$ and hydrogen treat gas rates of from about 213 $m^3/m^3$ to about 1068 $m^3/m^3$ (about 1200 SCF/B to about 6000 SCF/B).

Dewaxing Process

The product from the hydrocracking is then directly cascaded into a catalytic dewaxing reaction zone. Unlike a conventional process, no separation is required between the hydrocracking and catalytic dewaxing stages. Elimination of the separation step has a variety of consequences. With regard to the separation itself, no additional equipment is needed. In one form, the catalytic dewaxing stage and the hydrocracking stage are located in the same reactor. Alternatively, hydrocracking and catalytic dewaxing processes may take place in separate reactors. Eliminating the separation step also avoids any need to repressurize the feed. Instead, the effluent from the hydrocracking stage can be maintained at processing pressures as the effluent is delivered to the dewaxing stage.

Eliminating the separation step between hydrocracking and catalytic dewaxing also means that any sulfur in the feed to the hydrocracking step will still be in the effluent that is passed from the hydrocracking step to the catalytic dewaxing step. A portion of the organic sulfur in the feed to the hydrocracking step will be converted to $H_2S$ during hydrotreating. Similarly, organic nitrogen in the feed will be converted to ammonia. However, without a separation step, the $H_2S$ and $NH_3$ formed during hydrotreating will travel with the effluent to the catalytic dewaxing stage. The lack of a separation step also means that any light gases ($C_1$-$C_4$) formed during hydrocracking will still be present in the effluent. The total combined sulfur from the hydrotreating process in both organic liquid form and gas phase (hydrogen sulfide) may be greater than 1,000 ppm by weight, or at least 2,000 ppm by weight, or at least 5,000 ppm by weight, or at least 10,000 ppm by weight, or at least 20,000 ppm by weight, or at least 40,000 ppm by weight. For the present disclosure, these sulfur levels are defined in terms of the total combined sulfur in liquid and gas forms fed to the dewaxing stage in parts per million (ppm) by weight on the hydrotreated feedstock basis.

Elimination of a separation step between hydrocracking and catalytic dewaxing is enabled in part by the ability of a dewaxing catalyst to maintain catalytic activity in the presence of elevated levels of nitrogen and sulfur. Conventional catalysts often require pre-treatment of a feedstream to reduce the sulfur content to less than a few hundred ppm. By contrast, hydrocarbon feedstreams containing up to 4.0 wt % of sulfur or more can be effectively processed using the inventive catalysts. In an embodiment, the total combined sulfur content in liquid and gas forms of the hydrogen containing gas and hydrotreated feedstock can be at least 0.1 wt %, or at least 0.2 wt %, or at least 0.4 wt %, or at least 0.5 wt %, or at least 1 wt %, or at least 2 wt %, or at least 4 wt %. Sulfur content may be measured by standard ASTM methods D2622.

In an alternative embodiment, a simple flash high pressure separation step without stripping may be performed on the effluent from the hydrotreating reactor without depressurizing the feed. In such an embodiment, the high pressure separation step allows for removal of any gas phase sulfur and/or nitrogen contaminants in the gaseous effluent. However, because the separation is conducted at a pressure comparable to the process pressure for the hydrotreating or hydrocracking step, the effluent will still contain substantial amounts of dissolved sulfur. For example, the amount of dissolved sulfur in the form of $H_2S$ can be at least 100 vppm, or at least 500 vppm, or at least 1000 vppm, or at least 2000 vppm, or at least 5000 vppm, or at least 7000 vppm.

Hydrogen treat gas circulation loops and make-up gas can be configured and controlled in any number of ways. In the direct cascade, treat gas enters the hydrotreating reactor and can be once through or circulated by compressor from high pressure flash drums at the back end of the hydrocracking and/or dewaxing section of the unit. In the simple flash configuration, treat gas can be supplied in parallel to both the hydrotreating and the hydrocracking and/or dewaxing reactor in both once through or circulation mode. In circulation mode, make-up gas can be put into the unit anywhere in the high pressure circuit preferably into the hydrocracking/dewaxing reactor zone. In circulation mode, the treat gas may be scrubbed with amine, or any other suitable solution, to remove $H_2S$ and $NH_3$. In another form, the treat gas can be recycled without cleaning or scrubbing. Alternately, the liquid effluent may be combined with any hydrogen containing gas, including but not limited to $H_2S$ containing gas.

Preferably, the dewaxing catalysts according to the invention are zeolites that perform dewaxing primarily by isomerizing a hydrocarbon feedstock. More preferably, the catalysts are zeolites with a unidimensional pore structure. Suitable catalysts include 10-member ring pore zeolites, such as EU-1, ZSM-35 (or ferrierite), ZSM-11, ZSM-57, NU-87, SAPO-11, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23.

In various embodiments, the catalysts according to the invention further include a metal hydrogenation component. The metal hydrogenation component is typically a Group VI and/or a Group VIII metal. Preferably, the metal hydrogenation component is a Group VIII noble metal. More preferably, the metal hydrogenation component is Pt, Pd, or a mixture thereof.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 5 wt % or less based on catalyst, or 2.5 wt % or less, or 1 wt % or less, or 0.75 wt % or less. For embodiments where the metal is Pt, Pd, another Group VIII noble metal, or a combination thereof, the amount of metal is preferably from 0.1 to 2 wt %, more preferably 0.25 to 1.8 wt %, and even more preferably from 0.4 to 1.5 wt %.

Preferably, the dewaxing catalysts used in processes according to the invention are catalysts with a low ratio of silica to alumina. For example, for ZSM-48, the ratio of silica to alumina in the zeolite can be less than 200:1, or less than 110:1, or less than 100:1, or less than 90:1, or less than 80:1. In preferred embodiments, the ratio of silica to alumina can be from 30:1 to 200:1, 60:1 to 110:1, or 70:1 to 100:1.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less.

Alternatively, the binder and the zeolite particle size are selected to provide a catalyst with a desired ratio of micropore surface area to total surface area. In dewaxing catalysts used according to the invention, the micropore surface area corresponds to surface area from the unidimensional pores of zeolites in the dewaxing catalyst. The total surface corresponds to the micropore surface area plus the external surface area. Any binder used in the catalyst will not contribute to the micropore surface area and will not significantly increase the total surface area of the catalyst. The external surface area represents the balance of the surface area of the total catalyst minus the micropore surface area. Both the binder and zeolite can contribute to the value of the external surface area. Preferably, the ratio of micropore surface area to total surface area for a dewaxing catalyst will be equal to or greater than 25%.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.2 to 2 wt %, or 0.3 to 1 wt %.

In yet another embodiment, a binder composed of two or more metal oxides can also be used. In such an embodiment, the weight percentage of the low surface area binder is preferably greater than the weight percentage of the higher surface area binder.

Alternatively, if both metal oxides used for forming a mixed metal oxide binder have a sufficiently low surface area, the proportions of each metal oxide in the binder are less important. When two or more metal oxides are used to form a binder, the two metal oxides can be incorporated into the catalyst by any convenient method. For example, one binder can be mixed with the zeolite during formation of the zeolite powder, such as during spray drying. The spray dried zeolite/binder powder can then be mixed with the second metal oxide binder prior to extrusion.

In yet another embodiment, the dewaxing catalyst is self-bound and does not contain a binder.

Process conditions in the catalytic dewaxing zone include a temperature of from 200 to 450° C., preferably 270 to 400° C., a hydrogen partial pressure of from 1.8 to 34.6 mPa (250 to 5000 psi), preferably 4.8 to 20.8 mPa, a liquid hourly space velocity of from 0.2 to 10 v/v/hr, preferably 0.5 to 3.0, and a hydrogen circulation rate of from 35.6 to 1781 $m^3/m^3$ (200 to 10,000 scf/B), preferably 178 to 890.6 $m^3/m^3$ (1000 to 5000 scf/B).

Post-Hydrotreatment

The effluent from the dewaxing stage may then be optionally conducted to a final hydrotreatment step. The catalyst in this hydrotreatment step may be the same as those described above for the first hydrotreatment. The reaction conditions for the second hydrotreatment step can also be similar to the conditions for the first hydrotreatment.

After the post-hydrotreatment, various fractions of the effluent may be suitable for use as a diesel fuel or a lubricant basestock. However, in some embodiments, the resulting lubricant basestock may be only partially dewaxed. In such embodiments, further processing may be necessary for fractions desired for use as a lubricant basestock. For example, after the post-hydrotreatment step, the effluent can be fractionated to produce a diesel fuel portion and a lubricant basestock portion. The lubricant basestock portion can then be subjected to a solvent dewaxing step or another catalytic dewaxing step in order to achieve desired properties for the lubricant basestock. The lubricant basestock portion can then be hydrofinished and vacuum stripped.

Process Example 1

In one embodiment, the effluent from the hydrotreating step can be directly cascaded to the hydrocracking step. The hydrotreatment and hydrocracking catalysts may be located in a single reactor. This may be referred to herein as a direct cascade embodiment (see FIG. 5(*b*)). Depending on the other catalysts and the choice of reaction conditions, the products of the process may show improved viscosities, viscosity indices, saturates content, low temperature properties, volatilities and depolarization. The reactors can also be operated in any suitable catalyst-bed arrangement mode, for example, fixed bed, slurry bed, or ebulating bed although fixed bed, co-current downflow is normally utilized. In embodiments where the effluent from the hydrotreating step is directly cascaded to the hydrocracking step, the conditions in the hydrotreating step can be selected to match the conditions in the hydrocracking step.

Figure 5A:
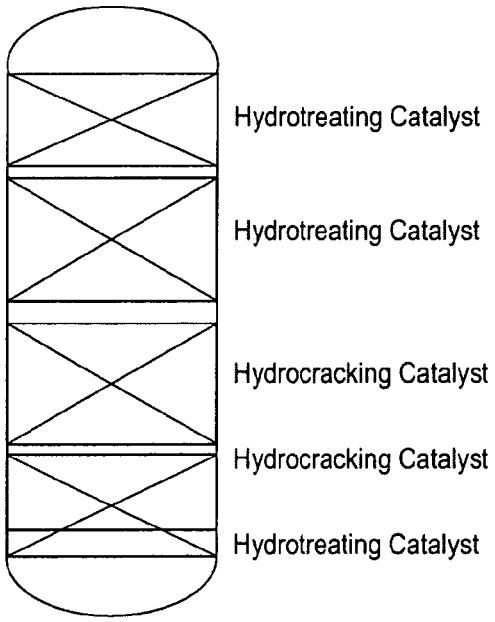
FIG. 5(*a*) shows a prior art system for producing a dewaxed distillate/diesel fuel and a lubricant basestock and FIG. 5(*b*) shows a "direct cascade" process embodiment of the present disclosure for producing a dewaxed distillate/diesel fuel and a lubricant basestock.
Figure 5B:
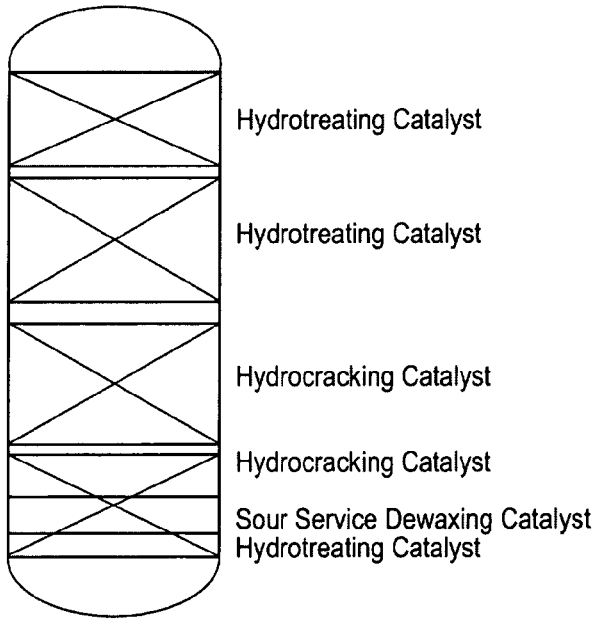

FIG. 5 schematically shows a comparison between a conventional reaction system (FIG. 5(*a*)) and one reaction system suitable for carrying out the present invention (FIG. 5(*b*)). FIG. 5(*a*) shows a prior art reaction system with a conventional reactor for performing a hydrocracking reaction.

FIG. 5(*b*) shows one embodiment of an inventive reaction system for performing the direct cascade process. The initial beds of the reactor include hydrotreating catalyst for removing heteroatom contaminants from a feed. The feed is then exposed to hydrocracking catalyst, preferably without intermediate separation. After hydrocracking, the effluent from the hydrocracking step is exposed to a dewaxing catalyst, without intermediate separation. After dewaxing, the effluent from the dewaxing step is exposed to a second hydrotreatment catalyst for additional removal of heteroatoms and to saturate undesirable olefinic species.

In the conventional prior art scheme, any catalytic dewaxing and/or catalytic isomerization is performed in a separate reactor. This is due to the fact conventional catalysts are poisoned by the heteroatom contaminants (such as $H_2S$ $NH_3$, organic sulfur and/or organic nitrogen) typically present in the hydrocracker effluent. Thus, in a conventional scheme, a separation step is used to first decrease the amount of the heteroatom contaminants. Because a distillation also needs to be performed to separate various cuts from the hydrocracker effluent, the separation may be performed at the same time as distillation, and therefore prior to dewaxing. This means that some valuable hydrocarbon molecules that could be used in a diesel or lube basestock cut are left out.

In the direct cascade embodiment of FIG. 5(*b*), a layer of dewaxing catalyst has been included between the hydrocracking step and the final hydrotreatment. By using a contaminant tolerant catalyst, a mild dewaxing step can be performed on the entire effluent from the hydrocracking step. This means that all molecules present in the hydrocracking effluent are exposed to mild dewaxing. This mild dewaxing will modify the boiling point of longer chain molecules, thus allowing molecules that would normally exit a distillation step as bottoms to be converted to molecules suitable for lubricant basestock. Similarly, some molecules suitable for lubricant basestock will be converted to diesel range molecules. The net effect is that more of the hydrocracker effluent will be incorporated into high value products, as opposed to being separated into bottoms that likely will be cracked for gasoline. The amount of diesel and/or lubricant basestock should also be increased, depending on the nature of the feedstock.

In FIG. 5(*b*), the first hydrotreating step, hydrocracking step, sour service dewaxing step and second hydrotreating step are performed in the same reactor. It is advantageous to minimize the number of reactors. Alternatively, each of these steps could be performed in separate reactor. For example, the hydrocracking step could be performed in one reactor and the subsequent sour service dewaxing step in a separate reactor without any separation between the two reactors.

Process Example 2

Figure 6:
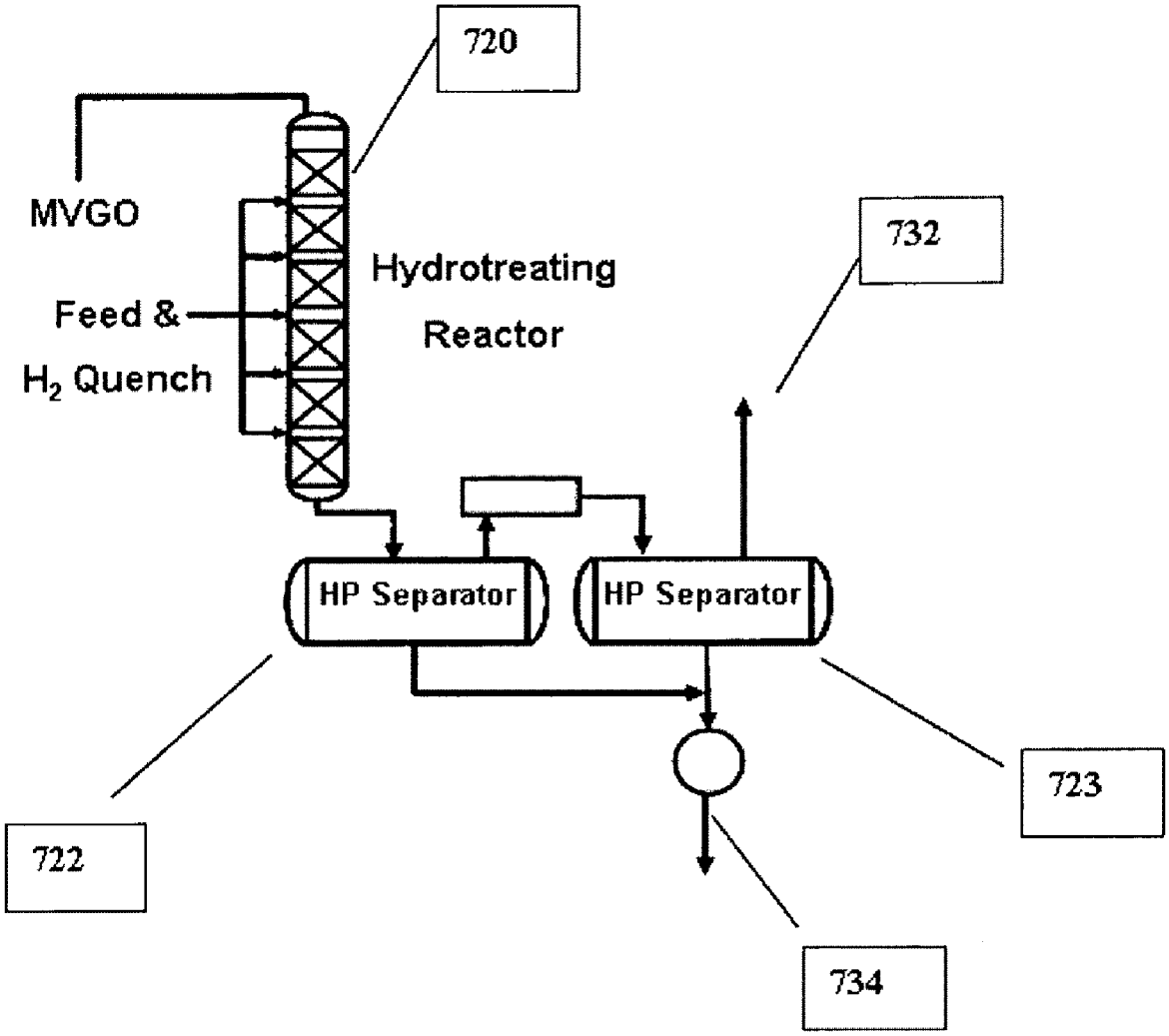
FIG. 6 shows an "interstage high pressure separation" process embodiment of the present disclosure for producing a dewaxed distillate/diesel fuel and a lubricant basestock.

In an alternative embodiment, the effluent from the hydrotreating step can be passed through a high pressure separator to flash off $H_2S$ and $NH_3$ before the subsequent hydrocracking step. This may be referred to herein as an "interstage high-pressure separation" embodiment (see FIG. 6). The interstage high pressure separation embodiment may result in higher conversion in the downstream hydrocracking/hydrotreatment reactor. FIG. 6 schematically shows one embodiment of an inventive reaction system for performing the interstage high pressure separation process. FIG. 6 schematically depicts a configuration for a hydrotreating reactor 720 and a subsequent high pressure separation device. In FIG. 6, the entire effluent from the hydrotreating reactor 720 is passed into at least one high pressure separation device, such as the pair of high pressure separators 722 and 723. The high pressure separation device disengages the gas phase portion of the effluent from the liquid phase portion. The resulting effluent 734, which contains dissolved $H_2S$ and possibly organic sulfur is then recombined with a hydrogen containing gas. The hydrogen containing gas may contain $H_2S$. The combined mixture is then transported to another reactor including a hydrocracking catalyst. After hydrocracking, the effluent from the hydrocracking step is exposed without intermediate separation to a sour service dewaxing catalyst for isomerization. In one form, the hydrocracking catalyst and the dewaxing catalyst are located in the same reactor. The effluent from the dewaxing stage may then be optionally conducted to a final hydrotreatment step then separated into various cuts by a fractionator. These cuts can include, for example, a lighter fuel type product such as a naphtha cut, a lighter fuel type product such as a diesel cut, and a heavier lube basestock cut. The lubricant basestock portion can then be subjected to a solvent dewaxing step or another catalytic dewaxing step in order to achieve desired properties for the lubricant basestock. The lubricant basestock portion can then be hydrofinished and vacuum stripped. The high pressure separation will remove some gaseous sulfur and nitrogen from the effluent, which is removed as a sour gas stream 732 for further treatment. However, the separated effluent 734 that is passed to the dewaxing stage can still contain, for example, more than 1000 ppm by weight of total combined sulfur in liquid and gas forms on the hydrotreated feedstock basis. This partial reduction in the sulfur and nitrogen content of the effluent can improve the activity and/or lifetime of the dewaxing catalyst, as the dewaxing catalyst will be exposed to a less severe sour environment.

In another form, the hydrocracking catalyst and the dewaxing catalyst are located in two separate reactors with no intermediate separation. After the sour service dewaxing catalyst, the dewaxed hydrocracked effluent may be transported to a second hydrotreatment catalyst for additional removal of heteroatoms and to saturate undesirable olefinic species. The second hydrotreating step may be located within the same reactor as the hydrocracking and dewaxing steps or may be in a separate downstream reactor. After the final hydrotreatment step, the effluent is then separated into various cuts by a fractionator. These cuts can include, for example, a lighter fuel type product such as a naphtha cut, a lighter fuel type product such as a diesel cut, and a heavier lube basestock cut. The lubricant basestock portion can then be subjected to a solvent dewaxing step or another catalytic dewaxing step in order to achieve desired properties for the lubricant basestock. The lubricant basestock portion can then be hydrofinished and vacuum stripped.

Dewaxing Catalyst Synthesis

In one form the of the present disclosure, the catalytic dewaxing catalyst includes from 0.1 wt % to 3.33 wt % framework alumina, 0.1 wt % to 5 wt % Pt, 200:1 to 30:1 $SiO_2$:$Al_2O_3$ ratio and at least one low surface area, refractory metal oxide binder with a surface area of 100 $m^2/g$ or less.

One example of a molecular sieve suitable for use in the claimed invention is ZSM-48 with a $SiO_2$:$Al_2O_3$ ratio of less than 110, preferably from about 70 to about 110. In the embodiments below, ZSM-48 crystals will be described variously in terms of "as-synthesized" crystals that still contain the (200:1 or less $SiO_2$:$Al_2O_3$ ratio) organic template; calcined crystals, such as Na-form ZSM-48 crystals; or calcined and ion-exchanged crystals, such as H-form ZSM-48 crystals.

The ZSM-48 crystals after removal of the structural directing agent have a particular morphology and a molar composition according to the general formula:

$$(n)SiO_2:Al_2O_3$$

where n is from 70 to 110, preferably 80 to 100, more preferably 85 to 95. In another embodiment, n is at least 70, or at least 80, or at least 85. In yet another embodiment, n is 110 or less, or 100 or less, or 95 or less. In still other embodiments, Si may be replaced by Ge and Al may be replaced by Ga, B, Fe, Ti, V, and Zr.

The as-synthesized form of ZSM-48 crystals is prepared from a mixture having silica, alumina, base and hexamethonium salt directing agent. In an embodiment, the molar ratio of structural directing agent:silica in the mixture is less than 0.05, or less than 0.025, or less than 0.022. In another embodiment; the molar ratio of structural directing agent:silica in the mixture is at least 0.01, or at least 0.015, or at least 0.016. In still another embodiment, the molar ratio of structural directing agent:silica in the mixture is from 0.015 to 0.025, preferably 0.016 to 0.022. In an embodiment, the as-synthesized form of ZSM-48 crystals has a silica:alumina molar ratio of 70 to 110. In still another embodiment, the as-synthesized form of ZSM-48 crystals has a silica:alumina molar ratio of at least 70, or at least 80, or at least 85. In yet another embodiment, the as-synthesized form of ZSM-48 crystals has a silica:alumina molar ratio of 110 or less, or 100 or less, or 95 or less. For any given preparation of the as-synthesized form of ZSM-48 crystals, the molar composition will contain silica, alumina and directing agent. It should be noted that the as-synthesized form of ZSM-48 crystals may have molar ratios slightly different from the molar ratios of reactants of the reaction mixture used to prepare the as-synthesized form. This result may occur due to incomplete incorporation of 100% of the reactants of the reaction mixture into the crystals formed (from the reaction mixture).

The ZSM-48 composition is prepared from an aqueous reaction mixture comprising silica or silicate salt, alumina or soluble aluminate salt, base and directing agent. To achieve the desired crystal morphology, the reactants in reaction mixture have the following molar ratios:

$SiO_2$:$Al_2O_3$ (preferred)=70 to 110
$H_2O$: $SiO_2$=1 to 500
OH—: $SiO_2$=0.1 to 0.3
OH—: $SiO_2$ (preferred)=0.14 to 0.18
template: $SiO_2$=0.01-0.05
template: $SiO_2$ (preferred)=0.015 to 0.025

In the above ratios, two ranges are provided for both the base:silica ratio and the structure directing agent:silica ratio. The broader ranges for these ratios include mixtures that result in the formation of ZSM-48 crystals with some quantity of Kenyaite and/or needle-like morphology. For situations where Kenyaite and/or needle-like morphology is not desired, the preferred ranges should be used.

The silica source is preferably precipitated silica and is commercially available from Degussa. Other silica sources include powdered silica including precipitated silica such as Zeosil® and silica gels, silicic acid colloidal silica such as Ludox® or dissolved silica. In the presence of a base, these other silica sources may form silicates. The alumina may be in the form of a soluble salt, preferably the sodium salt and is commercially available from US Aluminate. Other suitable aluminum sources include other aluminum salts such as the chloride, aluminum alcoholates or hydrated alumina such as gamma alumina, pseudobohemite and colloidal alumina. The base used to dissolve the metal oxide can be any alkali metal hydroxide, preferably sodium or potassium hydroxide, ammonium hydroxide, diquaternary hydroxide and the like. The directing agent is a hexamethonium salt such as hexamethonium dichloride or hexamethonium hydroxide. The anion (other than chloride) could be other anions such as hydroxide, nitrate, sulfate, other halide and the like. Hexamethonium dichloride is N,N,N,N',N',N'-hexamethyl-1,6-hexanediammonium dichloride.

In an embodiment, the crystals obtained from the synthesis according to the invention have a morphology that is free of fibrous morphology. Fibrous morphology is not desired, as this crystal morphology inhibits the catalytic dewaxing activity of ZSM-48. In another embodiment, the crystals obtained from the synthesis according to the invention have a morphology that contains a low percentage of needle-like morphology. The amount of needle-like morphology present in the ZSM-48 crystals can be 10% or less, or 5% or less, or 1% or less. In an alternative embodiment, the ZSM-48 crystals can be free of needle-like morphology. Low amounts of needle-like crystals are preferred for some applications as needle-like crystals are believed to reduce the activity of ZSM-48 for some types of reactions. To obtain a desired morphology in high purity, the ratios of silica:alumina, base:silica and directing agent:silica in the reaction mixture according to embodiments of the invention should be employed. Additionally, if a composition free of Kenyaite and/or free of needle-like morphology is desired, the preferred ranges should be used.

The as-synthesized ZSM-48 crystals should be at least partially dried prior to use or further treatment. Drying may be accomplished by heating at temperatures of from 100 to 400° C., preferably from 100 to 250° C. Pressures may be atmospheric or subatmospheric. If drying is performed under partial vacuum conditions, the temperatures may be lower than those at atmospheric pressures.

Catalysts are typically bound with a binder or matrix material prior to use. Binders are resistant to temperatures of the use desired and are attrition resistant. Binders may be catalytically active or inactive and include other zeolites, other inorganic materials such as clays and metal oxides such as alumina, silica, titania, zirconia, and silica-alumina. Clays may be kaolin, bentonite and montmorillonite and are commercially available. They may be blended with other materials such as silicates. Other porous matrix materials in addition to silica-aluminas include other binary materials such as silica-magnesia, silica-thoria, silica-zirconia, silica-beryllia and silica-titania as well as ternary materials such as silica-alumina-magnesia, silica-alumina-thoria and silica-alumina-zirconia. The matrix can be in the form of a co-gel. The bound ZSM-48 framework alumina will range from 0.1 wt % to 3.33 wt % framework alumina.

ZSM-48 crystals as part of a catalyst may also be used with a metal hydrogenation component. Metal hydrogenation components may be from Groups 6-12 of the Periodic Table based on the IUPAC system having Groups 1-18, preferably Groups 6 and 8-10. Examples of such metals include Ni, Mo, Co, W, Mn, Cu, Zn, Ru, Pt or Pd, preferably Pt or Pd. Mixtures of hydrogenation metals may also be used such as Co/Mo, Ni/Mo, Ni/W and Pt/Pd, preferably Pt/Pd. The amount of hydrogenation metal or metals may range from 0.1 to 5 wt %, based on catalyst. In an embodiment, the amount of metal or metals is at least 0.1 wt %, or at least 0.25 wt %, or at least 0.5 wt %, or at least 0.6 wt %, or at least 0.75 wt %, or at least 0.9 wt %. In another embodiment, the amount of metal or metals is 5 wt % or less, or 4 wt % or less, or 3 wt % or less, or 2 wt % or less, or 1 wt % or less. Methods of loading metal onto ZSM-48 catalyst are well known and include, for example, impregnation of ZSM-48 catalyst with a metal salt of the hydrogenation component and heating. The ZSM-48 catalyst containing hydrogenation metal may also be suffided prior to use.

High purity ZSM-48 crystals made according to the above embodiments have a relatively low silica:alumina ratio. This lower silica:alumina ratio means that the present catalysts are more acidic. In spite of this increased acidity, they have superior activity and selectivity as well as excellent yields. They also have environmental benefits from the standpoint of health effects from crystal form and the small crystal size is also beneficial to catalyst activity.

For catalysts according to the invention that incorporate ZSM-23, any suitable method for producing ZSM-23 with a low $SiO_2$:$Al_2O_3$ ratio may be used. U.S. Pat. No. 5,332,566 provides an example of a synthesis method suitable for producing ZSM-23 with a low ratio of $SiO_2$:$Al_2O_3$. For example, a directing agent suitable for preparing ZSM-23 can be formed by methylating iminobispropylamine with an excess of iodomethane. The methylation is achieved by adding the iodomethane dropwise to iminobispropylamine which is solvated in absolute ethanol. The mixture is heated to a reflux temperature of 77° C. for 18 hours. The resulting solid product is filtered and washed with absolute ethanol.

The directing agent produced by the above method can then be mixed with colloidal silica sol (30% $SiO_2$), a source of alumina, a source of alkali cations (such as Na or K), and deionized water to form a hydrogel. The alumina source can be any convenient source, such as alumina sulfate or sodium aluminate. The solution is then heated to a crystallization temperature, such as 170° C., and the resulting ZSM-23 crystals are dried. The ZSM-23 crystals can then be combined with a low surface area binder to form a catalyst according to the invention.

The following are examples of the present disclosure and are not to be construed as limiting.

EXAMPLES

Example 1A

Synthesis of ZSM-48 Crystals with $SiO_2/Al_2/O_3$ Ratio of ~70/1 and Preferred Morphology A mixture was prepared from a mixture of DI water, Hexamethonium Chloride (56% solution), Ultrasil silica, Sodium Aluminate solution (45%), and 50% sodium hydroxide solution, and ~0.15% (to reaction mixture) of ZSM-48 seed crystals. The mixture had the following molar composition:

| | |
|---|---|
| $SiO2/SiO_2/Al_2O_3$ | ~80 |
| $H_2O/SiO_2$ | ~15 |
| $OH^-/SiO_2$ | ~0.15 |
| $Na^+/SiO_2$ | ~0.15 |
| Template/$SiO_2$ | ~0.02 |

The mixture was reacted at 320° F. (160° C.) in a 5-gal autoclave with stirring at 250 RPM for 48 hours. The product was filtered, washed with deionized (DI) water and dried at 250° F. (120° C.). The XRD pattern of the as-synthesized material showed the typical pure phase of ZSM-48 topology. The SEM of the as-synthesized material shows that the material was composed of agglomerates of small irregularly shaped crystals (with an average crystal size of about 0.05 microns). The resulting ZSM-48 crystals had a $SiO_2/Al_2O_3$ molar ratio of ~71. The as-synthesized crystals were converted into the hydrogen form by three ion exchanges with ammonium nitrate solution at room temperature, followed by drying at 250° F. (120° C.) and calcination at 1000° F. (540° C.) for 4 hours. The resulting ZSM-48 (70:1 $SiO_2$: $Al_2O_3$) crystals had a total surface area of ~290 $m^2/g$ (external surface area of ~130 $m^2/g$), and an Alpha value of ~100, ~40% higher than current ZSM-48(90:1 $SiO_2$: $Al_2O_3$) Alumina crystals. The H-form crystals were then steamed at 700° F., 750° F., 800° F., 900° F., and 1000° F. for 4 hours for activity enhancement and Alpha values of these treated products are shown below:

170 (700° F.), 150 (750° F.), 140 (800° F.), 97 (900° F.), and 25 (100° F.).

Example 1B

Preparation of the Sour Service Dewaxing Catalyst

The sour service hydroisomerization catalyst was prepared by mixing 65 wt % ZSM-48 (~70/1 $SiO_2/Al_2O_3$, see Example 1A) with 35 wt % P25 $TiO_2$ binder and extruding into a 1/20" quadralobe. This catalyst was then precalcined in nitrogen at 1000° F., ammonium exchanged with ammonium nitrate, and calcined at 1000° F. in full air. The extrudate was then steamed for 3 hours @ 750° F. in full steam. The steamed catalyst was impregnated to 0.6 wt % platinum via incipient wetness using platinum tetraamine nitrate, dried, and then calcined at 680° F. for 3 hours in air. The ratio of micropore surface area to total surface area is about 45%.

Example 2

Process Evaluation of Sour Service Hydrocracking/Hydroisomerization

This example evaluates the benefits for replacing a portion of the hydrocracking (HDC) catalyst with a sour service hydroisomerization (HI) catalyst. The hydrocracking catalyst used in this study was Zeolite Z-3723 catalyst.

As illustrated shown in Table 1, the reactors, 2 reactors in series, were loaded to evaluate the benefits for replacing approximately 50% of the hydrocracking (HDC) catalyst with the sour service hydroisomerization (HI) catalyst described in Example 1. The feed properties of the MVGO are shown in Table 2 below.

TABLE 1

Reactor Loading Schemes

| | Base HDT/HDC/HDT | Sour Service HDT/HDC/HI/HDT |
|---|---|---|
| Reactor #1 | | |
| KF-848 (Hydrotreating) | 40% | 40% |
| Reactor #2 | | |
| KF-848 (Hydrotreating) | 30% | 30% |
| Zeolyst Z-3723 (Hydrocracking) | 25% | 12.5% |
| 0.6 wt % Pt on 35/65 $TiO_2$/ZSM-48 (Hydroisomerization) | — | 12.5% |
| KF-848 (Hydrotreating) | 5% | 5% |

TABLE 2

MVGO Feed Properties

| Feed Properties | MVGO Feed |
|---|---|
| 700° F. + in Feed (wt %) | 90 |
| Feed Pour Point, ° C. | 30 |
| Solvent Dewaxed Oil Feed Pour Point, ° C. | −19 |
| Solvent Dewaxed Oil Feed 100° C. Viscosity, cSt | 7.55 |
| Solvent Dewaxed Oil Feed VI | 57.8 |
| Organic Sulfur in Feed (ppm by weight) | 25,800 |
| Organic Nitrogen in Feed (ppm by weight) | 809 |

The catalysts were first dried in hydrogen to 225° F. by heating at 25° F./hr at 800 psig. Once the reactor temperatures reached 225° F., a spiked feed (DMDS mixed with LGO to 2.3 wt % S) was introduced at 1 LHSV and 1000 scf/B hydrogen gas to feed ratio at 800 psig. After soaking the catalyst for 3 hours, the reactors were heated to 450° F. at 40° F./hr. Temperature was then held at 450° F. for approximately 10 hours. A second spiked feed (DMDS mixed with MVGO to 2.5 wt % S) was introduced at 1 LHSV and 1,500 scf/B hydrogen gas to feed ratio at 800 psig and 450° F. After 1 hour, the reactor temperatures were increased to 610° F. at 40° F./hr. Temperatures were then held at 610° F. for approximately 5 hours. The reactors were then heated to 664° F. at 40° F./hr and held at 664° F. for 15 hours. After 15 hours, the sulfiding was completed and MVGO feed was introduced to the unit and conditions adjusted to achieve about 40% conversion. During the evaluation, reactor #2 was operated about 25° F. higher in temperature than reactor #1 to simulate a commercial temperature profile. The sour service hydroisomerization catalyst did not receive a specific drydown or prereduction prior to being loaded into the reactor and was subjected to the same activation procedure as the hydrotreating and hydrocracking catalysts as described above.

Process conditions, conversion, yields and total liquid product properties are summarized in Table 3. The base case includes only hydrocracking catalyst, whereas the HDC/HI case includes the hydrocracking catalyst and the hydroisomerization catalyst in a single reactor.

TABLE 3

Pilot Plant Evaluation

| | Condition 1 | | Condition 2 | | Condition 3 | | Condition 4 |
|---|---|---|---|---|---|---|---|
| | Base | HDC/HI | Base | HDC/HI | Base | HDC/HI | HDC/HI |
| Equiv. Feed Rate, KBD | 35 | | 35 | | 35 | | 35 |
| Reactor #1 Temp, ° F. | 680 | | 690 | | 705 | | 720 |
| Reactor #2 Temp, ° F. | 705 | | 715 | | 730 | | 740 |
| Treat Gas Rate, SCF/B | ~4000 | | ~4000 | | ~4000 | | ~4000 |
| Overall LHSV, 1/hr | 0.75 | | 0.75 | | 0.75 | | 0.75 |
| Pressure, psig | ~1250 | | ~1250 | | ~1250 | | ~1250 |
| 650° F.+ Conversion, wt % | 26 | 14 | 26.5 | 17.0 | 39.7 | 29.0 | 43 |
| Yields, vol % | | | | | | | |
| Gas ($C_4$-), wt % | 0.4 | 0.6 | 0.9 | 1.0 | 1.2 | NA | 2.0 |

TABLE 3-continued

| Pilot Plant Evaluation | | | | | | | |
|---|---|---|---|---|---|---|---|
| | Condition 1 | | Condition 2 | | Condition 3 | | Condition 4 |
| | Base | HDC/HI | Base | HDC/HI | Base | HDC/HI | HDC/HI |
| Naphtha ($C_5$-350° F.) | 6.8 | 2.2 | 6.8 | 3.3 | 11.8 | 5.0 | 11.9 |
| Distillate (350-700° F.) | 28.0 | 23.5 | 29.0 | 24.4 | 32.0 | 33.0 | 39.4 |
| Bottoms (700° F.+) | 63.8 | 74.2 | 63.3 | 71.5 | 57.9 | 62.0 | 47.6 |
| Total Liquid Product | | | | | | | |
| API Gravity | 31.5 | 28.0 | 31.6 | 28.6 | 34 | 31.3 | 34.3 |
| Sulfur, ppm | 486 | 800 | 302 | 400 | 108 | 60 | 50 |
| Nitrogen, ppm | 37 | 85 | 24 | 35 | 13 | 10 | 8 |
| Pour Point, ° C. | — | — | 13 | 7 | 15 | 5 | −8 |

Figure 2:
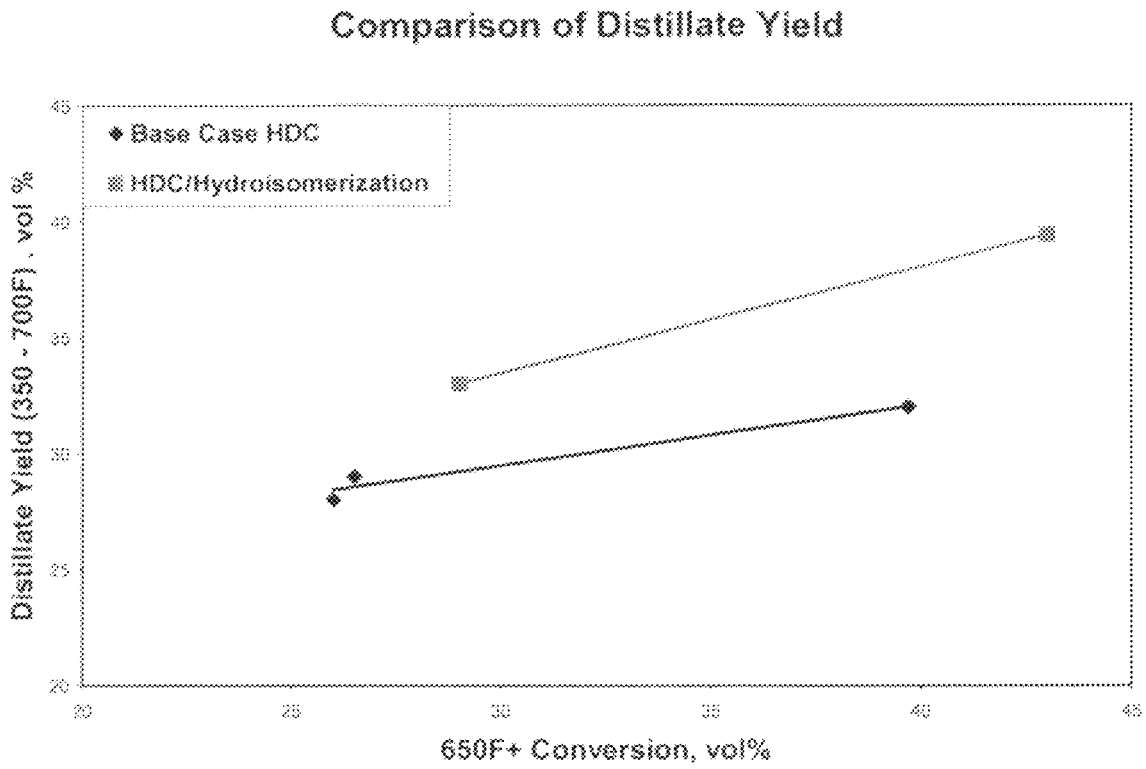
FIG. 2 is a plot of distillate yield versus 650° F.+ conversion.
Figure 3:
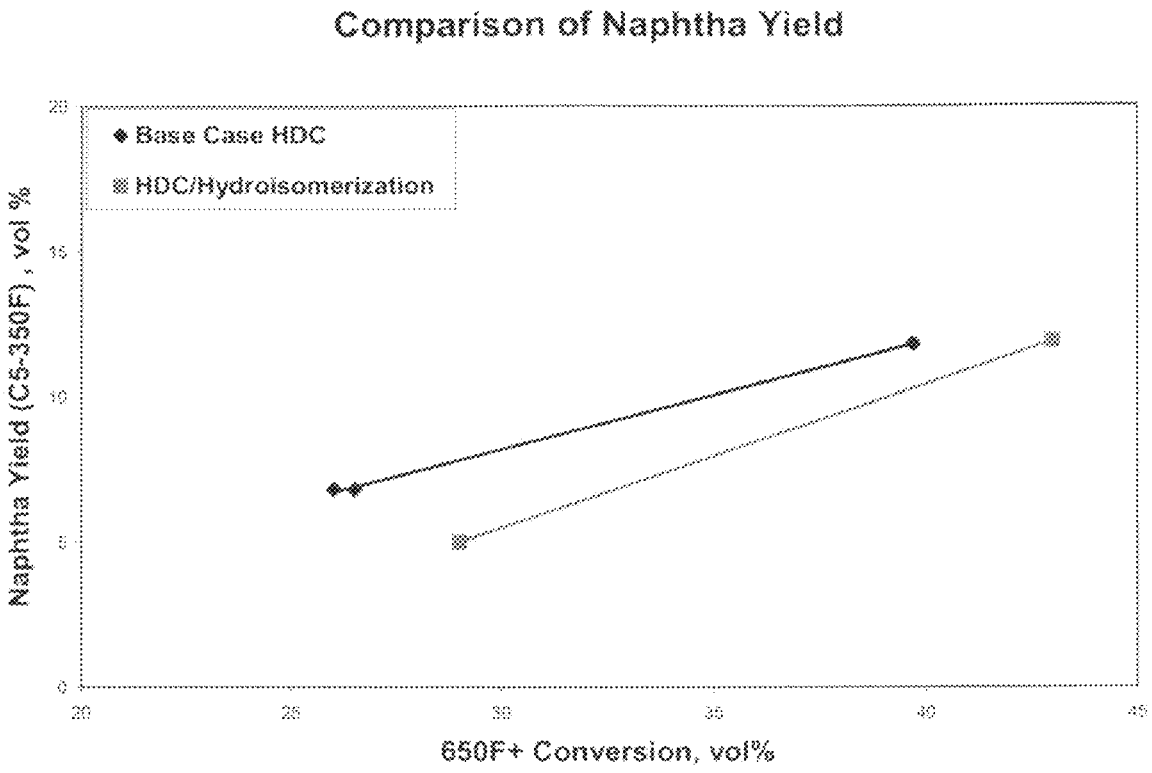
FIG. 3 is a plot of naphtha yield versus 650° F.+ conversion.

As shown, replacing 50% of the hydrocracking catalyst with the sour service hydroisomerization catalyst appears to reduce 650° F.+ conversion at constant conditions. However, at constant conversion, the distillate yield is significantly increased and the total liquid product pour point is significantly reduced. Correspondingly, naphtha yield is reduced and the pour points of the distillate and bottoms products are likely reduced. Bottoms yield is similar for lower conversion, but lower for higher levels of conversion. Yields are shown in FIGS. 1, 2 and 3.

Example 3

Process Evaluation of Sour Service Hydrocracking/Hydroisomerization

Figure 4:
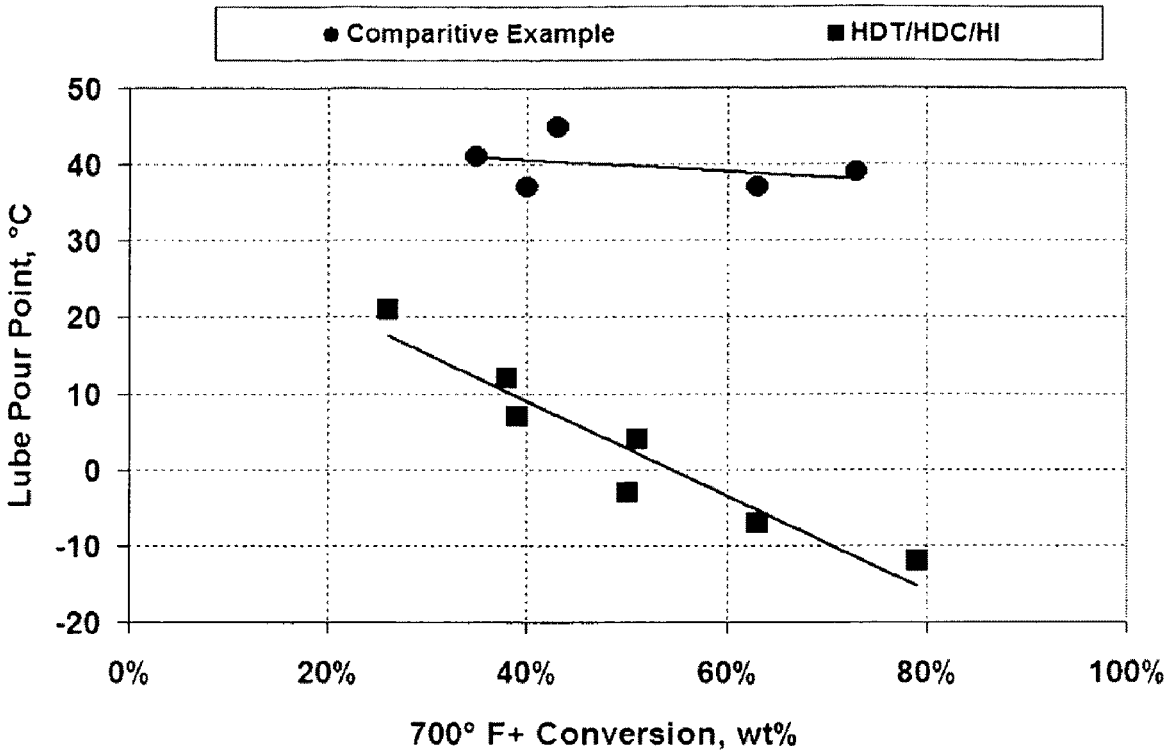
FIG. 4 is a plot of lube pour point versus 700° F.+ conversion.

The total liquid products from Example 2 were collected, distilled and analyzed for fuels and lubes yields and properties. See Tables 4-6, and FIG. 4.

TABLE 4

| Comparative case - Hydrotreating (R1) followed by hydrocracking (R2) | | | | | |
|---|---|---|---|---|---|
| Lube Properties | Comparative Example | Comparative Example | Comparative Example | Comparative Example | Comparative Example |
| 700° F.+ Conversion, wt % | 35 | 40 | 43 | 63 | a73 |
| Lube Pour Point, ° C. | 41 | 37 | 45 | 37 | 39 |
| 700° F.+ Yield, wt % | 65 | 60 | 57 | 37 | 27 |

TABLE 5

| Inventive case - Lube Properties for Hydrotreating (R1) followed by HDC/Dewaxing (R2) | | | | | | | |
|---|---|---|---|---|---|---|---|
| Lube Properties | HDT/HDC/HI | HDT/HDC/HI | HDT/HDC/HI | HDT/HDC/HI | HDT/HDC/HI | HDT/HDC/HI | HDT/HDC/HI |
| 700° F.+ Conversion, wt % | 26 | 38 | 39 | 50 | 51 | 63 | 79 |
| Lube Pour Point, ° C. | 21 | 12 | 7 | −3 | 4 | −7 | −12 |
| Lube viscosity at 100° C., cSt | | 7.2 | | | | | 4.9 |
| Lube V.I. | | 105 | | | | | 112 |
| 700° F.+ Yield, wt % | 74 | 62 | 61 | 50 | 49 | 37 | 21 |
| Lube % Saturates* | | 70 | | | | | 84 |

*% Saturates (wt %) = [1 − (Total Aromatics of 700° F.+ Lube (moles/gram) * Calculated Molecular Weight)] * 100 where Molecular Weight is calculated based on Kinematic Viscosity at 100° C. and 40° C. of the 700° F.+ Lube.

TABLE 6

| Inventive case - Diesel Fuel Properties for Hydrotreating (R1) followed by HDC/Dewaxing (R2) Along with Comparative Case (HT/HDC) | | |
|---|---|---|
| Diesel Properties | HDT/HDC/HI | Comparative Example |
| Diesel Cloud Point, ° C. | −30.3 | 3.1 |
| Diesel Calculated Cetane Index* | 51.7 | 50.4 |
| Diesel API | 34 | 32 |
| Diesel Yield, wt % | 45 | 32 |
| 700° F. + Conversion, wt % | 50 | 40 |

*Cetane Index was calculated according to ASTMD976.

Integrated hydrotreating (HDT) followed by hydrocracking (HDC) and hydroisomerization (HI) resulted in improved diesel yield and diesel low temperature properties over that of the comparative example. In addition, the diesel quality for the integrated process as shown by the calculated Cetane Index was equivalent to that of the comparative example.

Example 4

Process Evaluation of Semi-Sweet Service Hydrocracking at High Pressure

To evaluate the benefits for intermediate removal of $NH_3$ and $H_2S$ after the hydrotreating zone, hydrotreated MVGO from R1 was stripped to remove $NH_3$ before routing into R2. At constant T and LHSV, significant increase in conversion and yields was observed.

TABLE 7

| | | R1-R2 Direct Cas cade | | | |
|---|---|---|---|---|---|
| 650+ Conv | wt % | 50 | 54 | 60 | 65 |
| LPG | wt % | 3 | 3 | 4 | 4 |
| Naphtha | wt % | 11 | 13 | 16 | 20 |
| Distillate | wt % | 44 | 46 | 46 | 47 |
| Bottoms | wt % | 42 | 38 | 34 | 29 |
| | | R1-Strip NH3-R2 | | | |
| 650+ Conv | wt % | 53 | 63 | 78 | 87 |
| LPG | wt % | 3 | 3 | 4 | 4 |
| Naphtha | wt % | 11 | 15 | 21 | 26 |
| Distillate | wt % | 49 | 51 | 52 | 52 |
| Bottoms | wt % | 37 | 31 | 23 | 18 |

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for producing a a diesel fuel, and lubricant basestock, comprising:

contacting a hydrotreated feedstock and a hydrogen containing gas with a hydrocracking catalyst under effective hydrocracking conditions to produce a hydrocracked effluent, wherein the hydrotreated feedstock is a vacuum gas oil, cascading the entire hydrocracked effluent, without separation, to a catalytic dewaxing stage, and dewaxing the entire hydrocracked effluent under effective catalytic dewaxing conditions, wherein the combined total sulfur in liquid and gaseous forms fed to the dewaxing stage is greater than 1000 ppm by weight of sulfur on the hydrotreated feedstock basis, wherein the hydrocracking catalyst includes a zeolite Y based catalyst, and wherein the dewaxing catalyst includes at least one unidimensional, 10-member ring pore zeolite, at least one Group VIII metal, and at least one low surface area, metal oxide, refractory binder, and wherein the dewaxing catalyst comprises a micropore surface area to total surface area of greater than or equal to 25%, wherein the total surface area equals the surface area of the external zeolite plus the surface area of the binder.

2. The method of claim 1, further comprising hydrotreating the entire hydrotreated, hydrocracked, dewaxed effluent under effective hydrotreating conditions.

3. The method of claim 2, further comprising fractionating the hydrotreated, entire, hydrotreated, hydrocracked, dewaxed effluent to produce at least a lubricant basestock portion; and further dewaxing the lubricant basestock portion.

4. The method of claim 3, wherein the further dewaxing the lubricant basestock portion comprises at least one of solvent dewaxing the lubricant basestock portion and catalytically dewaxing the lubricant basestock portion.

5. The method of claim 3, wherein the dewaxed lubricant basestock is hydrofinished under effective hydrofinishing conditions and vacuum stripped.

6. The method of claim 1 wherein the hydrogen as is chosen from a hydrotreated gas effluent, a clean hydrogen gas, a recycle gas and combinations thereof.

7. The method of claim 1, wherein the hydrotreated feedstock is cascaded without separation to the hydrocracking step.

8. The method of claim 1, wherein the dewaxing catalyst comprises a molecular sieve having a $SiO_2$:$Al_2O_3$ ratio of 200:1 to 30:1 and comprises from 0.11 wt % to 3.33 wt % framework $Al_2O_3$ content.

9. The method of claim 8, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

10. The method of claim 8, wherein the molecular sieve is EU-11, ZBM-30, ZSM-48, ZSM-23, or a combination thereof.

11. The method of claim 8, wherein the molecular sieve is ZSM-48, ZSM-23, or a combination thereof.

12. The method of claim 8, wherein the molecular sieve is ZSM-48.

13. The method of claim 1, wherein the metal oxide, refractory binder has a surface area of 100 $m^2/g$ or less.

14. The method of claim 1, wherein the metal oxide, refractory binder has a surface area of 80 $m^2/g$ or less.

15. The method of claim 1, wherein the metal oxide, refractory binder has a surface area of 70 $m^2/g$ or less.

16. The method of claim 1, wherein the metal oxide, refractory binder is silica, alumina, titania, zirconia, or silica-alumina.

17. The method of claim 1, wherein the metal oxide, refractory binder further comprises a second metal oxide, refractory binder different from the first metal oxide, refractory binder.

18. The method of claim 17, wherein the second metal oxide is an silica, alumina, titania, zirconia, or silica-alumina.

19. The method of claim 1, wherein the dewaxing catalyst includes from 0.1 to 5 wt % platinum.

20. The method of claim 1, wherein the hydrocracking and dewaxing steps occur in a single reactor.

21. The method of claim 1, wherein the hydrocracking and dewaxing steps occur in two or more reactors in series.

22. The method of claim 2, wherein the hydrocracking, dewaxing and second hydrotreating steps occur in a single reactor.

23. The method of claim 2, wherein the hydrocracking, dewaxing and second hydrotreating steps occur in two or more reactors in series.

24. The method of claim 2, wherein the first hydrotreating, hydrocracking, dewaxing, and second hydrotreating steps occur in a single reactor.

25. The method of claim 2, wherein the first hydrotreating, hydrocracking, dewaxing, and second hydrotreating steps occur in two or more reactors in series.

26. A method for producing a diesel fuel, and a lubricant basestock, comprising:

contacting a hydrotreated feedstock and a hydrogen containing gas with a hydrocracking catalyst under effective hydrocracking conditions to produce a hydrocracked effluent, wherein the hydrotreated feedstock is a vacuum gas oil, wherein prior to the contacting step, the effluent from the hydrotreating step is fed to at least one high pressure separator to separate the gaseous portion of the hydrotreated effluent from the liquid portion of the hydrotreated effluent, wherein the entire hydrocracked effluent is cascaded, without separation, to a catalytic dewaxing stage, and dewaxing the entire hydrocracked effluent under effective catalytic dewaxing conditions, wherein the combined total sulfur in liquid and gaseous forms fed to the dewaxing stage is greater than 1000 ppm by weight of sulfur on the hydrotreated feedstock basis, wherein the hydrocracking catalyst includes a zeolite Y based catalyst, and wherein the dewaxing catalyst includes at least one unidimensional, 10-member ring pore zeolite, at least one Group VIII metal, and at least one low surface area, metal oxide, refractory binder, and wherein the dewaxing catalyst comprises a micropore surface area to total surface area of greater than or equal to 25% the total surface area equals the surface area of the external zeolite plus the surface area of the binder.

27. The method of claim 26 wherein the hydrotreated effluent after separation includes dissolved $H_2S$ and optionally organic sulfur.

28. The method of claim 26 wherein the hydrotreated effluent after separation is recombined with a hydrogen containing gas.

29. The method of claim 28 wherein the hydrogen containing gas includes $H_2S$.

30. The method of claim 26 wherein the hydrogen gas is chosen from a hydrotreated gas effluent, a clean hydrogen gas, a recycle gas and combinations thereof.

31. The method of claim 26, further comprising hydrotreating the entire hydrotreated, hydrocracked, dewaxed effluent under effective hydrotreating conditions.

32. The method of claim 31, further comprising fractionating the entire hydrotreated, hydrocracked, dewaxed, and hydrotreated effluent to produce at least a lubricant basestock portion; and further dewaxing the lubricant basestock portion.

33. The method of claim 32, wherein the further dewaxing the lubricant basestock portion comprises at least one of solvent dewaxing the lubricant basestock portion and/or catalytically dewaxing the lubricant basestock portion.

34. The method of claim 32, wherein the further dewaxed lubricant basestock is hydrofinished under effective hydrofinishing conditions and then vacuum stripped.

35. The method of claim 26, wherein the dewaxing catalyst comprises a molecular sieve having a $SiO_2$:$Al_2O_3$ ratio of 200:1 to 30:1 and comprises from 0.1 wt % to 3.33 wt % framework $Al_2O_3$ content.

36. The method of claim 35, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

37. The method of claim 35, wherein the molecular sieve is EU-2, EU-11, ZBM-30, ZSM-48, ZSM-23, or a combination thereof.

38. The method of claim 35, wherein the molecular sieve is ZSM-48, ZSM-23, or a combination thereof.

39. The method of claim 35, wherein the molecular sieve is ZSM-48.

40. The method of claim 26, wherein the metal oxide, refractory binder has a surface area of 100 $m^2/g$ or less.

41. The method of claim 26, wherein the metal oxide, refractory binder has a surface area of 80 $m^2/g$ or less.

42. The method of claim 26, wherein the metal oxide, refractory binder has a surface area of 70 $m^2/g$ or less.

43. The method of claim 26, wherein the metal oxide, refractory binder is silica, alumina, titania, zirconia, or silica-alumina.

44. The method of claim 26, wherein the metal oxide, refractory binder further comprises a second metal oxide, refractory binder different from the first metal oxide, refractory binder.

45. The method of claim 44, wherein the second metal oxide, refractory binder is silica, alumina, titania, zirconia, or silica-alumina.

46. The method of claim 26, wherein the dewaxing catalyst includes from 0.1 to 5 wt % platinum.

47. The method of claim 26, wherein the hydrocracking and dewaxing steps occur in a single reactor.

48. The method of claim 26, wherein the hydrocracking and dewaxing steps occur in two or more reactors in series.

49. The method of claim 31, wherein the hydrocracking, dewaxing and second hydrotreating steps occur in a single reactor.

50. The method of claim 31, wherein the hydrocracking, dewaxing and second hydrotreating steps occur in two or more reactors in series.

51. The method of claim 31, wherein the first hydrotreating, hydrocracking, dewaxing, and second hydrotreating steps occur in two or more reactors in series.

* * * * *